US005172570A

United States Patent [19]

Wade et al.

[11] Patent Number: 5,172,570

[45] Date of Patent: Dec. 22, 1992

[54] PATTERNED FABRIC, PROCESS AND WARP KNITTING MACHINE FOR THE PRODUCTION THEREOF

[75] Inventors: Heins Wade, Rodgau; Gerhard Bergmann, Heusenstamm, both of Fed. Rep. of Germany

[73] Assignee: Karl Mayer Textilmaschinenfabrik GmbH, Obertshausen, Fed. Rep. of Germany

[21] Appl. No.: 719,786

[22] Filed: Jun. 24, 1991

[30] Foreign Application Priority Data

Jun. 28, 1990 [DE] Fed. Rep. of Germany ..... 4020549

[51] Int. Cl.[5] ..... D04B 21/00

[52] U.S. Cl. ..... 66/195; 66/192

[58] Field of Search ..... 66/190, 192, 194, 195, 66/196

[56] References Cited

U.S. PATENT DOCUMENTS

| | | | |
|---|---|---|---|
| 3,413,825 | 12/1968 | Winch | 66/192 |
| 3,453,844 | 7/1969 | Heij | 66/192 |
| 3,675,447 | 7/1972 | Jackson | 66/192 |
| 4,067,210 | 1/1978 | Arons et al. | 66/192 X |
| 4,395,889 | 8/1983 | Schnegg | 66/190 X |
| 4,608,290 | 8/1986 | Schnegg | 66/192 X |
| 4,631,933 | 12/1986 | Carey, Jr. | 66/192 |
| 4,773,238 | 9/1988 | Zafiroglu | 66/192 |

FOREIGN PATENT DOCUMENTS

| | | | |
|---|---|---|---|
| 2026933 | 12/1971 | Fed. Rep. of Germany | 66/192 |
| 6909811 | 12/1970 | Netherlands | 66/192 |

*Primary Examiner*—Werner H. Schroeder
*Assistant Examiner*—John J. Calvert
*Attorney, Agent, or Firm*—Omri M. Behr; Matthew J. McDonald

[57] ABSTRACT

A patterned fabric includes weft threads 3 and a fabric ground whose warped threads 2 are laid in a first area 4 in chain stitch and in a second area 5 in another stitch form. The second area 5 alternates with the first area 4 both in warp as well as weft direction. This provides, despite patterning by the warp threads, a surface stable fabric. The process for forming the patterned fabric is such that the fabric, after production, has a longitudinal extension of no greater than 25% and additionally is provided with a longitudinally stabilizing, stability improving arrangement step.

A warp knitting machine for the production of fabric 1 comprises a weft insert magazine and two jacquard guide bars. In substantially each working cycle a portion of the guides lay chain stitches and the remaining portion of the guides lay other stitch types. Substantially each guide lays sequentially chain stitches as well as other stitch types.

14 Claims, 5 Drawing Sheets

PATTERNED FABRIC, PROCESS AND WARP KNITTING MACHINE FOR THE PRODUCTION THEREOF

BACKGROUND OF THE INVENTION

The present invention is directed to a patterned knitted fabric, as well as a process and a warp knitting machine for the production thereof.

Known knitted can provide a very surface-stable fabric utilizing weft threads together with chain stitches. Such fabric however cannot be surface patterned. If one utilizes another stitch formation such as tricot, cloth, atlas, and their combinations one already obtains, even without the weft threads, a ground fabric which hangs together. The weft threads therefore serve substantially to provide transverse stability, however one has to take into consideration a disturbing lateral extendability.

The maximum transverse and longitudinal stability is obtained when the weft threads are bound in with chain threads. This longitudinal stability however is lost when the warp threads, for reasons of patterning, are laid in other stitch forms for example, tricot, cloth, atlas or combinations thereof since, the diagonally running stitch segments tend to weaken in the longitudinal direction.

An object of the present invention is to provide a patterned fabric, formed by utilizing warp threads, which nevertheless, has good surface stability.

SUMMARY OF THE INVENTION

In accordance with the illustrative embodiments demonstrating features and advantages of the present invention, there is provided a patterned knitted fabric having weft insert threads and a fabric ground. The majority of the warp threads of the fabric ground, for the purpose of patterning, are spatially distributed to alternate from chain stitches in primary areas to substitute stitches in secondary areas. The first and second areas are arranged to alternate both in a warp direction and in a weft direction.

According to a method of the same invention, patterned fabric can be produced with weft insert threads and a fabric ground. The method includes the step of spatially distributing the majority of the warp threads, for the purpose of patterning, to alternate from chain stitches in primary areas to substitute stitches in secondary areas. These first and second areas are arranged to alternate both in a warp direction and in a weft direction. The size and position of the first and second areas are arranged to give the fabric, upon completion, a longitudinal extendability of up to 25%. Another step in the method is performing a finishing process to provide increased longitudinal stability.

A warp knitting machine according to the principles of the same invention can produce a patterned knitted fabric having weft insert threads and a fabric ground. The majority of the warp threads of the fabric ground, for the purpose of patterning, are spatially distributed to alternate from chain stitches in primary areas to other stitches in secondary areas. These first and second areas are arranged to alternate both in a warp direction and in a weft direction. The machine includes a weft insertion magazine and a pair of jacquard guide bars. Each of the jacquard guide bars includes a plurality of thread guides displaceable by one needle's space. Each of the guides has an internally controllable displacement element.

Also included is a lateral movement control arrangement for the lateral movement of the jacquard guide bars. The machine also has a jacquard control arrangement for controlling the displacing elements as follows: (a) substantially in each working cycle a portion of the guides lay chain stitches and another portion of the guides lay other types of stitches, and (b) substantially each guide sequentially lays chain stitches as well as other stitches.

In accordance with the present invention there is provided a particular distribution of the less sensitive first area and the more sensitive second area to avoid longitudinal extension. This system lacks a continuous chain stitch for providing with each weft thread longitudinal stability, but does provide that the less longitudinally stable secondary areas are bordered on each side by the more stable primary areas. Thus the lesser longitudinal stability of the secondary area, corresponding to the nature of the stitch formation, is not or is just minimally noticeable.

There is thus provided a substantial surface stability of patterned knitted goods: not only is the global extension limited, but in the individual areas there is no buckling either. This feature is enhanced when the patterning is closer and further amplified when the first and second area are intimately intertwined. Within these parameters it is possible to provide a virtually unlimited number of patterns.

A further advantage is found therein that the weft threads are very differently covered by the different stitch forms and therefore the visible portions thereof contribute substantially to the optical effect. In particular, it is possible to provide pattern forms which are very similar to patterned woven goods.

It is particularly advantageous when the fabric ground is formed by weft threads and two complementary systems of pattern-forming warp threads. This again increases the number of patterning possibilities. Furthermore, no further warp threads are required for the fabric ground. There where both thread systems form pillars or pillar stitches, the thus formed stitch walls are bound with the weft threads to form a stable surface.

It is desirable that the first areas of the warp thread system partially overlap the second areas of the other warp thread system. Thus the pillars which are formed by the one weft thread system are prolonged by the pillars formed by the other weft thread system. This leads to an increased longitudinal stability.

The first areas should form at least 50% of the surface area of the fabric. This can occur for example, where two warp thread systems whose first areas each comprises at least 33% are laid in a correspondingly overlapped manner. It is advisable to provide that the second areas, at least in part, are formed as diagonal strips. This means that the edges contact the first areas both in the warp direction as well as the weft direction. It is further advantageous to provide that the weft threads are substantially thicker than the warp threads. This gives rise to a desirable optical appearance due to the exposed segments of the warp threads.

In a particularly preferred embodiment the fabric solely comprises one single weft thread system and two warp thread systems. This gives rise to fabric which is light, patterned, and surface stable.

A process for the formation of the patterned fabric in accordance with the present invention is characterized in that the size and position of the first and second areas is so chosen that after completion of the knitting process, the goods have a preferred longitudinal extension of maximally 25% and that at the same time there is provided a finishing process for further increasing the longitudinal stability. In particular, after knitting the longitudinal stability should not exceed 20%.

It is known to stabilize the surface stability of knitted fabric by means of a finishing process. This however, is only possible in a somewhat limited manner. Since, by means of the special distribution of the first and second areas, the longitudinal stability (and with the assistance of the weft threads, despite patterning, the transverse stability), has been brought to a higher level, it is possible, by means of said finishing process, to bring the fabric to an extraordinary higher level of surface stability.

In forming patterned fabric, one may use conventional warp knitting machines provided with weft thread magazines which utilize a plurality of differentially controlled guide bars, whose guides are only partially provided with weft threads. With such equipment it is only possible to produce rather simple patterns.

In order to achieve a greater variety of patterns in accordance with the present invention there is provided a warp knitting machine equipped with two jacquard guide bars with controllable displacement elements and with guides displaceable by one needle space, and with a lateral movement control arrangement for the control of lateral movement of the entire guide bar as well as a jacquard control arrangement for the displacement elements. The latter is so laid out or programed that in substantially every working cycle a portion of the guides form chain stitches and the other guides form other stitches and that substantially each guide sequentially forms chain stitches as well as other stitches. In the simplest case it is not necessary to provide further guide bars. The plurality of patterning is obtained by control of both jacquard guide bars and their appropriate displacement elements.

DETAILED DESCRIPTION OF THE DRAWINGS

Figure 1:
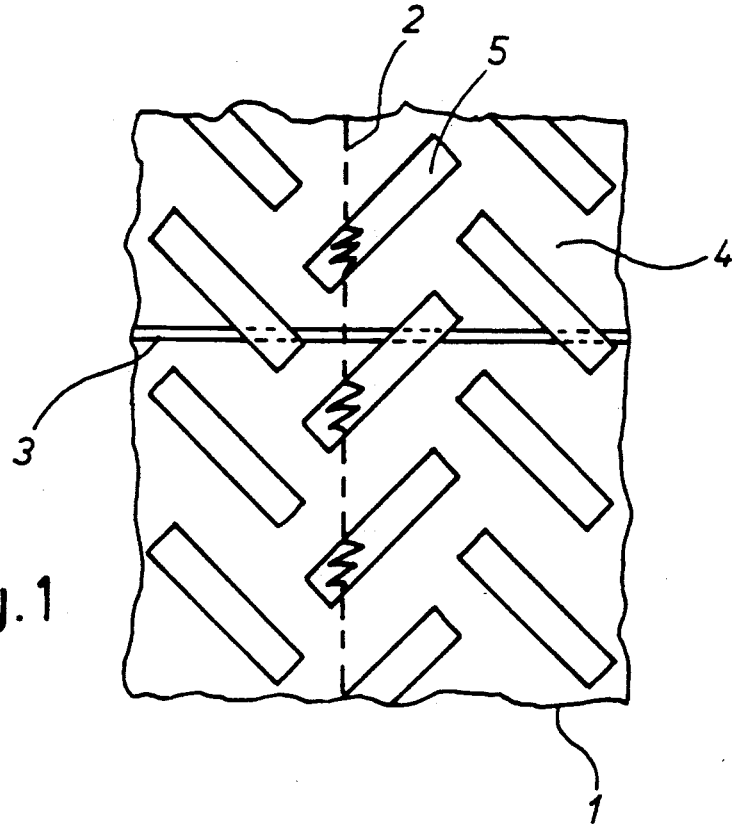
FIG. 1 is a schematic plan view of a segment of fabric produced in accordance with the present invention.

FIG. 1 shows a fragment of fabric 1 which is formed from warp threads 2 and has weft threads 3 knotted in therewith. There is formed a first area 4 in which the warp threads 2 are laid in chain stitch and a second segment 5 in which the warp threads 2 are laid in a different stitch form; in particular, tricot or cloth. This is indicated merely schematically in the drawing.

In the second segment 5, the warp threads 2 are better able to cover the weft threads 3. Therefore, an optical effect is achieved not only through different layings of the warp threads, but also between the interchange of the visible and covered portions of the weft threads. In particular, it is thus possible to achieve the effect of a surface patterned woven fabric.

The weft threads 3 interfere with stretching in the transverse direction. The longitudinal extension is controlled by the warp threads, wherein each warp thread has a reduced longitudinal extension in the area of the chain stitch binding and permits a greater extension in the area of the other stitch formations. However the latter only has a limited effect since on both sides of the second area 5, chair stitch warp threads are located. This gives rise to a very substantial level of surface stability. Stretching or buckling of the fabric is substantially prevented by an adequate alternation between the first and second areas.

Figure 2:
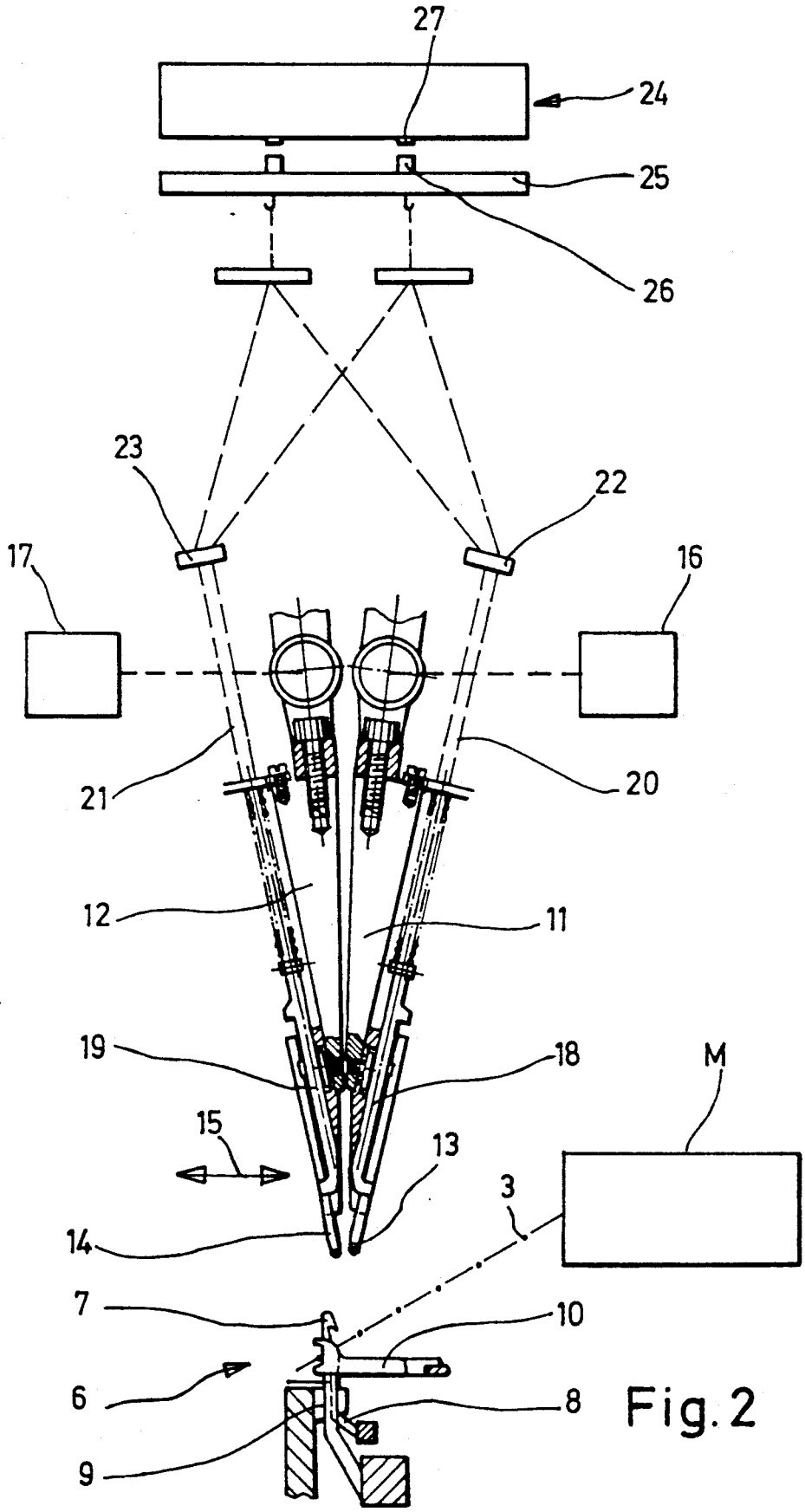
FIG. 2 is a schematic, elevational, cross-sectional view of the working elements of a warp knitting machine appropriate to form the fabric of the present invention.

FIG. 2 schematically illustrates a portion of the warp knitting machine which is utilized to form the fabric of FIG. 1. The working area 6 comprises needles with sliders 8, knock-over sinkers 9 and forwarding means 10 for weft threads 3, supplied by magazine weft thread arrangement M. There are further provided a first jacquard guide bar 11 and a second jacquard guide bar 12, provided with corresponding guides 13 and 14. Both jacquard guide bars are swung behind and in front of the needles 7 in the conventional manner as is indicated by arrow 15. They are provided with a schematically illustrated lateral movement control arrangement 16 and 17 by means of which they are moveable back and forth, in a tricot lap manner.

The guides 13 and 14 can be displaced by one needle space by means of displacing elements 18 and 19. The displacing elements are operated in the usual manner by harness cords 20 and 21. These harness cords run through bars 22 and 23 and are activated by a common jacquard control arrangement 24. Arrangement 24 can be of a conventional construction and can have various means for sequencing the operation of the harness cords, such as a computer. For this purpose, holding elements 26 are provided to control element 27 by bar 25 and there, in accordance with a predetermined program, are either held or not held. For example, the control elements 27 may be electromagnets and the holding element 26 may be the appropriate anchors or armature.

In the illustrated construction the control element 25 operates on a pair of harness cords 20 and 21 in such a manner that two mutually corresponding guides 13 and 14 are displaced in mutually opposite directions.

Figure 3:
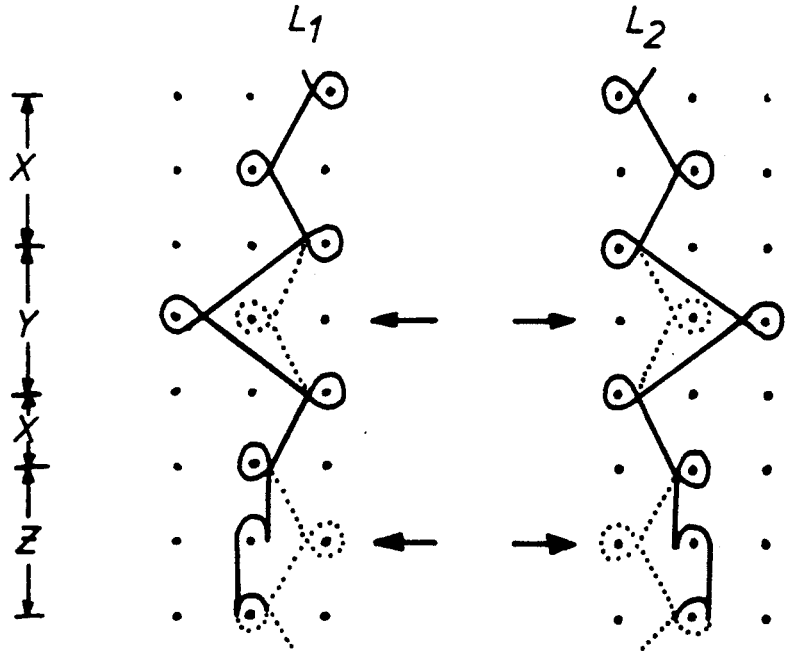
FIG. 3 is a diagram of the lateral movement and of the displacement of the jacquard guides.

FIG. 3 shows a lapping diagram by the jacquard guide bars 11 and 12. The jacquard guide bar 11 provides the lapping diagram L1 and the jacquard guide bar 12, the lapping diagram L2. When the guides are not displaced a tricot lap is provided in segment X. Following the displacement as shown by the arrows there is provided a cloth stitch in segment Y. In the displacement in the other end section there is provided a chain stitch in segment Z. The segment Z is the first area 4 (FIG. 1) and the sum of segments X and Y give the second area 5.

The corresponding guides 13 and 14 which alternately lay a tricot stitch around needle 7 are activated by a common control element 27. The displacement however, proceeds in opposite directions. This in combination with the fact that the jacquard guide bars 11 and 12 are more laterally in opposite directions leads to the noted mirror image construction in both lapping diagrams.

Figure 4:
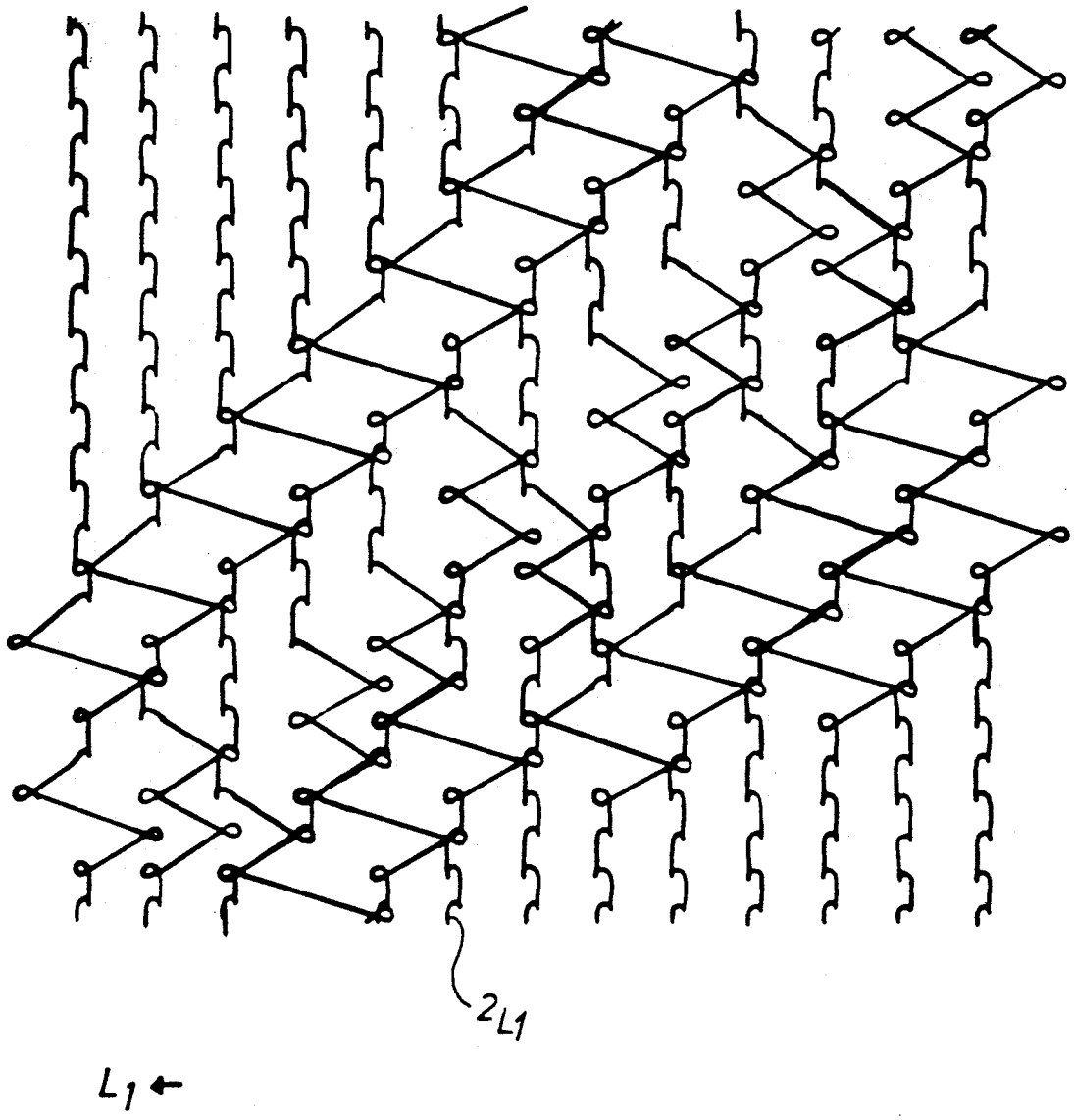
FIG. 4 is an example of the laying carried out by the first jacquard guide bar.

In FIG. 4 there is shown a portion of the composite lapping diagram L1 of the forward jacquard bar 11. It will be seen that each of the warp threads is laid in chain stitch, tricot stitch and cloth stitch. In the transfer from one stitch form to the other, gaps are created, which means that in that position, needle 7 does not have a warp thread laid about it.

Figure 5:
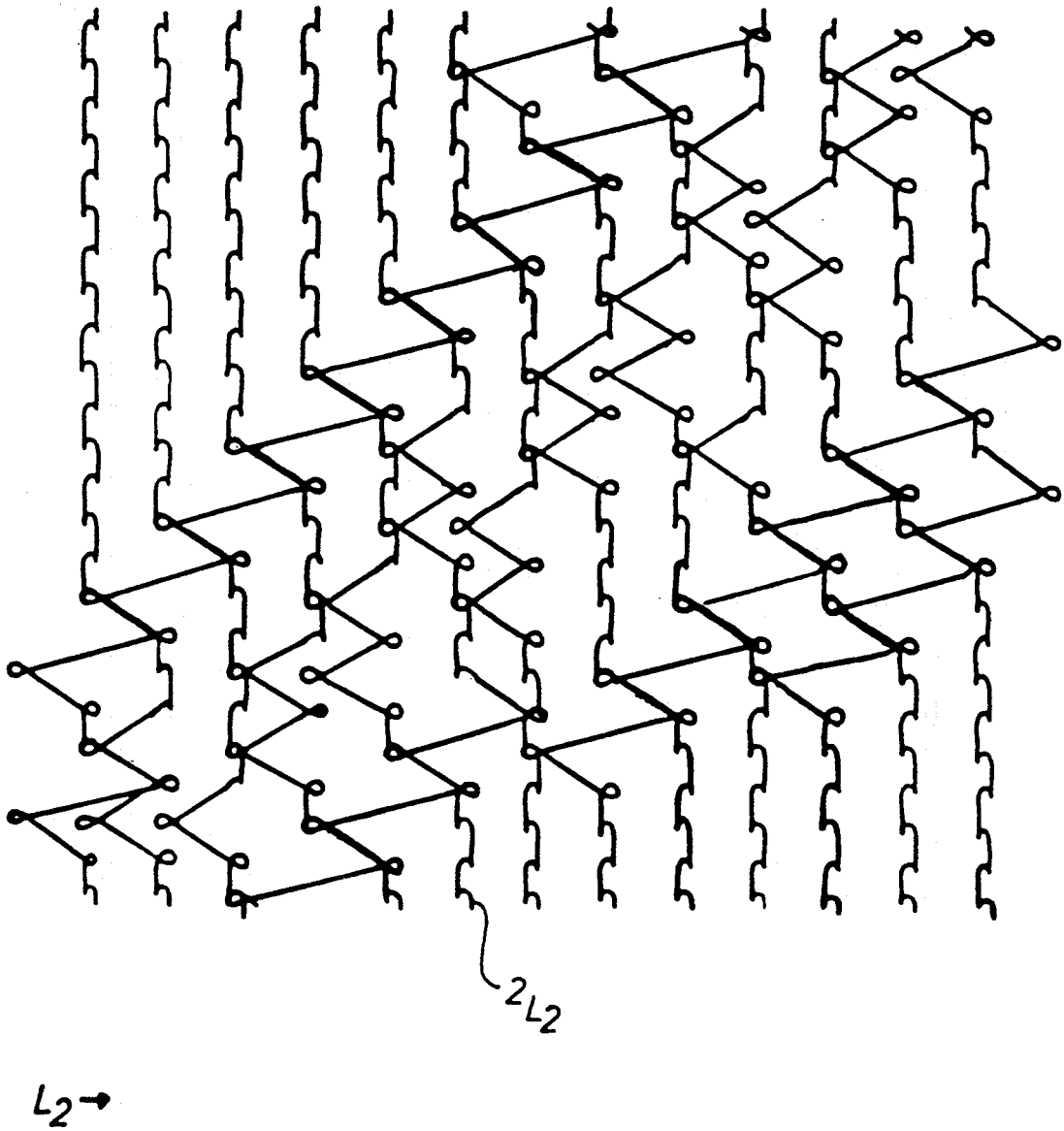
FIG. 5 is an example of the laying carried out by the second jacquard guide bar.

FIG. 5 shows the same area of the fabric for the lapping diagram L2 of the jacquard guide bar. In this situation the same description applies with the provision that the needles 7 left free by the first warp thread are laid about by the second warp thread. It is further to be noted that the mutual correspondence of the first and the second warp threads have a mirror image track which is shown in FIG. 3.

Figure 6:
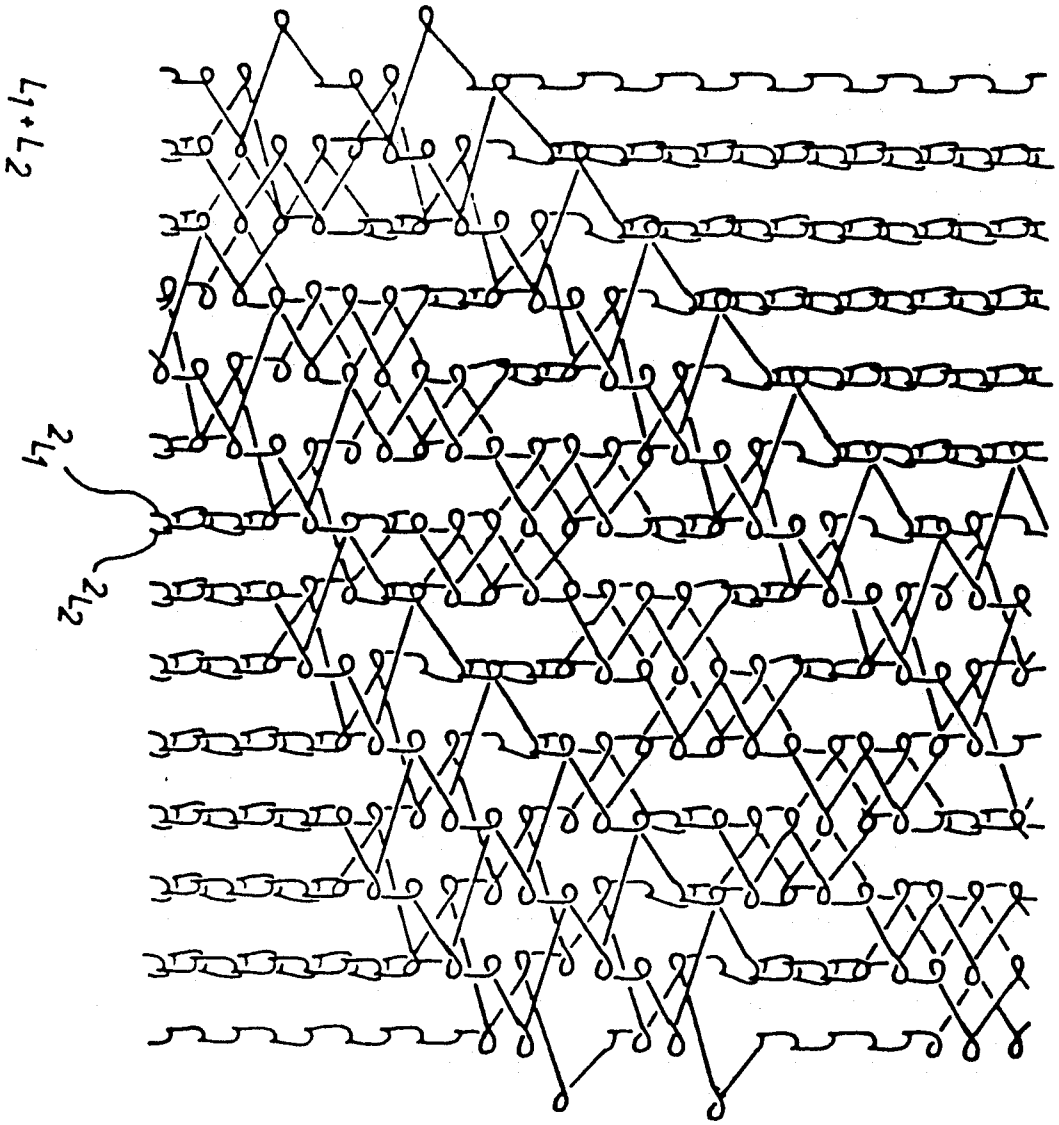
FIG. 6 is an example of the fabric obtained by the combination of both laying actions of FIGS. 4 and 5.

FIG. 6 shows the lapping diagram L1+L2 which is given when at the same time both lapping systems are utilized. In each work cycle a plurality of needles have thread laid about them. There is thus provided, a complex patterning because of the path of the side segment of the warp thread stitches. In order to differentiate, the warp threads 2 which are laid by the first jacquard guide bar 11 are designated L1 and the weft threads 2 which are laid by the other jacquard guide bar 12 are designated L2. As is shown in FIG. 6, both of the systems of warp threads 2 can be laid in very different combinations starting with doubling such as, chain-chain, tricot-tricot, cloth-cloth, as well as mixtures such as chain-tricot, chain-cloth or tricot-cloth and all this also in straight run as well as in crossing.

It should further be noted that when a weft thread 3 is also laid in, which is differentially covered by the different lapping combinations, a very broad based form of patterning arises. For example, one may utilize a thicker weft thread 3 and thinner warp threads 2 in combination, whereby the covering of the weft thread by two warp threads is optically less weighty than the freely left weft thread insert segment.

In one embodiment there is utilized polyester warp thread PE 110f 20 and acrylic weft thread Nm 14/2 which, utilizing substantially equal proportions of chain, tricot and cloth in both warp thread systems leads to a maximal extension in the longitudinal direction of 19%.

When a further finishing process is utilized wherein the fabric is heated to a temperature of about 80° C., the longitudinal extension drops from 9% to about 5%.

It should of course, be understood that jacquard guide bars 11 and 12 are each controlled by their own jacquard arrangement 24, so that the warp threads of the two guide bars can thus be laid totally independently from each other, which leads to a patterning ground wear from the warp threads and weft insertion threads themselves.

The jacquard guide bars can also be displaced in the manner of a chain stitch so that by means of displacement a tricot stitch is given. For simple patterns it is even possible to operate without jacquard guide bars and in place thereof, create the same stitch pattern on fully led weft threads in separately controllably guide bars.

We claim:

1. A patterned knitted fabric having weft insert threads and a fabric ground comprising at least one system of pattern forming warp threads, at least a majority of said warp threads, for the purpose of patterning, being spatially distributed to alternate both in a warp direction and in a weft direction from first areas each having a plurality of chain stitches, to second areas each having a plurality of different stitches.

2. A patterned knitted fabric in accordance with claim 1, wherein said different stitches are one or more stitches selected from a group consisting of tricot stitches, cloth stitches, and atlas stitches.

3. A fabric in accordance with claim 1 wherein the fabric ground comprises first and second complementary systems of pattern forming warp threads, at least a majority of said warp threads of said first system alternating stitches from said first areas to said second areas, at least a majority of the warp threads of said second complementary system, for the purpose of patterning, being spatially distributed to alternate both in a warp direction and in a weft direction from third areas each having a plurality of chain stitches, to fourth areas each having a plurality of different stitches.

4. A fabric in accordance with claim 3 wherein the first areas of said first system partially overlap the fourth areas of the second system to prolong pillar stitches formed by the first system of threads with pillar stitches formed by the second system of threads.

5. A fabric in accordance with claim 4 wherein the first and third areas of the first and second systems form at least 50% of the surface of the goods of the fabric.

6. A fabric in accordance with claim 1 wherein the second area is at least partially formed as diagonal strips.

7. A fabric in accordance with claim 3 wherein the second and fourth areas are at least partially formed as diagonal strips.

8. A fabric in accordance with claim 1 wherein the weft threads are substantially thicker than the warp threads.

9. A fabric in accordance with claim 3 wherein the weft threads are substantially thicker than the warp threads.

10. A fabric in accordance with claim 1 wherein the fabric is exclusively formed from a single weft thread system and two warp thread systems.

11. A fabric in accordance with claim 5 wherein the fabric is exclusively formed from a single weft thread system and two warp thread systems.

12. A fabric in accordance with claim 6 wherein the fabric is exclusively formed from a single weft thread system and two warp thread systems.

13. A method for the production of patterned fabric with weft insert threads and a fabric ground having warp threads, comprising the steps of:

spatially distributing at least a majority of the warp threads, for the purpose of patterning, to alternate both in a warp direction and in a weft direction from a plurality of chain stitches in first areas to a plurality of different stitches in second areas, the first and second areas having a size and position arranged to give the fabric, upon completion, a longitudinal extendability of up to 25%; and performing a finishing process to provide increased longitudinal stability.

14. The method of claim 13 wherein the finishing process includes the step of applying heat to the fabric.

* * * * *